US005235241A

United States Patent [19]

Van Eck et al.

[11] Patent Number: 5,235,241

[45] Date of Patent: Aug. 10, 1993

[54] ELECTRON GUN COMPONENT WITH ELECTRODE POSITIONING MEANS

[75] Inventors: Arnoldus H. M. Van Eck; Gerrit Van Der Heijden, both of Eindhoven, Netherlands

[73] Assignee: U.S. Philips Corporation, New York, N.Y.

[21] Appl. No.: 730,313

[22] Filed: Jul. 15, 1991

Related U.S. Application Data

[62] Division of Ser. No. 447,963, Dec. 7, 1989, Pat. No. 5,052,966.

[30] Foreign Application Priority Data

Dec. 19, 1988 [NL] Netherlands ..... 8803099

[51] Int. Cl.[5] ..... H01J 29/50

[52] U.S. Cl. ..... 313/414; 313/456; 313/457

[58] Field of Search ..... 313/414, 456, 457, 460

[56] References Cited

U.S. PATENT DOCUMENTS 3,890,528 6/1975 Say et al. ..... 313/414
4,473,775 9/1984 Hosokoshi et al. ..... 313/414 X
4,607,187 8/1986 Villamyi ..... 313/414
4,728,859 3/1988 Natsuhara et al. ..... 313/414 X
4,742,279 5/1988 Gerretsen et al. ..... 313/414 X

FOREIGN PATENT DOCUMENTS 0139464 10/1979 Japan .
0054739 5/1981 Japan .
0118339 7/1982 Japan .
0028162 2/1983 Japan .

*Primary Examiner*—Donald J. Yosko
*Assistant Examiner*—Ashok Patel
*Attorney, Agent, or Firm*—Robert J. Kraus

[57] ABSTRACT

A method of manufacturing an electron gun component, in which the electrodes are positioned in a jig by means of positioning means which are located at the edge of the electrodes. The method does not use pins to position the electrodes. In an exemplary embodiment, the electrodes are stacked in the jig with clearance. The positioning means are located at the vertices of a polygon which comprise the apertures in the electrodes. If an electrode is tubular in shape, the positioning means and the apertures in the electrode are preferably located in one plane.

17 Claims, 8 Drawing Sheets

ELECTRON GUN COMPONENT WITH ELECTRODE POSITIONING MEANS

CROSS REFERENCE TO RELATED APPLICATION

This is a division of U.S. Ser. No. 07/447,963, filed Dec. 7, 1989, which has issued as U.S. Pat. No. 5,052,966.

BACKGROUND OF THE INVENTION

The invention relates to a method of manufacturing an electron gun component which comprises a number of electrodes having at least one aperture, at least two electrodes having positioning means and a jig having further positioning means to cooperate with the positioning means, in which method the electrodes are stacked in the jig and positioned by means of the positioning means and the further positioning means, and the at least two electrodes are interconnected.

Electron guns are used, inter alia, in display tubes for colour display devices, projection display devices and data display devices.

A method of the type described in the opening paragraph is known from the abstract in the English language of Japanese Patent Application JP-A 56-54739, published in Patents abstracts of Japan vol. 5. No. 117, (E-67), (789), Jul. 28, 1981. In the Application a description is given of a method of manufacturing an in-line electron gun. The electrodes have one central aperture and two outer apertures. The jig comprises a pin on which the electrodes are stacked, which pin penetrates the central aperture, and two fixed and two movable jaws. The jaws cooperate with the positioning means and the pin to position the electrodes. Each electrode comprises a projection on either side of the in-line plane which extends away from the plane.

After the electrodes of an electron gun have been positioned in a jig, the electrodes are interconnected which is normally carried out by pressing a rod of ceramic glass which is heated to the flow temperature onto the projections, said rod permanently interconnecting the electrodes after it has cooled.

It has been found that the edges of the central aperture may be damaged which leads to failure of the electron gun, and that an electrode sometimes sticks to the pin so that it is difficult to remove the electron gun component from the pin.

SUMMARY OF THE INVENTION

One of the objects of the invention is to provide a method by means of which a reduction of the above problems is achieved.

To this end, a method of the type described in the opening paragraph is characterized in that in the stacking operation all apertures of the at least two electrodes are left clear.

"Left clear" is to be understood to mean herein that the apertures are not penetrated by pins.

As no aperture is penetrated by a pin, no aperture can be damaged by the pin or stick thereto.

The method according to the invention can be used for the manufacture of a component for an electron gun for generating one electron beam. Such electron guns are suitable for, for example, a monochrome display tube or a projection display tube. The method according to the invention can also be used for the manufacture of a component for an electron gun which, in operation, generates several, for example three, electron beams. Examples of such electron guns are the so-called delta and in-line electron guns.

An embodiment of the method according to the invention, in which the at least two electrodes are interconnected while supplying heat is characterized in that the at least two electrodes are stacked in the jig with a clearance such that during interconnecting the at least two electrodes the positioning means and the further positioning means cooperate with each other.

In the method according to the invention, the electrodes, when in the "cold" state, are stacked in the jig with clearance. During interconnecting, which is carried out, for example, by providing a connection member, for example a glass rod or a solder joint, which can be softened by heat, the temperature of the electrodes increases. The clearance is selected such that it disappears, at least substantially, when the electrodes are heated-up.

Consequently, in the "cold" state the positioning means and the further positioning means do not lie against each other. In the "hot" state, the electrodes with the positioning means at least substantially lie against the positioning means of the jig.

In the known method, the electrode, when in the "cold" state, is clamped between the movable and the fixed jaws and on the central pin. The electrode expands when it is heated by the connection member. As some of the jaws can be moved and forces are exerted on the electrodes when the connection member is provided, the central aperture may be displaced however and/or insecurities in accuracies positioning of the electrodes may occur or an electrode may stick to the pin, as will be explained hereinbelow.

Preferably, the at least two electrodes are positioned by means of positioning means which are located at least substantially at the vertices or the sides of a polygon comprising the centroid of all apertures.

When the positioning means are located at least substantially at the vertices of a polygon which comprises the centroid of all apertures, it is possible to position the electrode with a high degree of accuracy. Regarding the accuracy with which the electrodes are positioned, it is to be noted that it has been found in practice that a thin central pin, i.e., a pin having a cross-section in the order of 1 mm or smaller, does not determine the position of the electrodes but is bent such that it follows the apertures in the electrodes. Consequently, the method can be used very suitably if at least the central apertures in the at least two electrodes have a diameter of 1 mm or smaller.

Preferably, the at least two electrodes are the electrodes which can be located nearest the cathode. In general, these electrodes have the smallest apertures. There is a great chance that an aperture or pin becomes damaged.

A further preferred embodiment of the method according to the invention is characterized in that all apertures of a number of successive electrodes are left clear, preferably, all apertures of all electrodes are left clear. In this case, one jig can be used for many electron-gun constructions, and the chance of an electron gun sticking to a pin is absent.

Preferably, the position of the electrodes is checked while the electron gun component is located in the jig.

This saves time and precludes a sub-standard electron gun from continuing in the production line.

An embodiment of the invention is characterized in that the electrodes are separated by spacers.

Preferably, at least one of the electrodes is provided with at least one electric connection, while the electron gun is located in the jig. This is time-saving.

The invention also relates to an electron gun component manufactured according to the invention.

The component may be, for example, a composite electrode or an assembly of electrodes or an entire electron gun.

The invention also relates to an electron gun component comprising at least two electrodes having at least one aperture and positioning means, at least one electrode being tubular in shape.

According to the invention, the component of this type is characterized in that the positioning means and the at least one aperture of the tubular electrode extend at least substantially in one plane.

Such a component can be used advantageously in the above-described method. The position of the at least one aperture in the tubular electrode is determined more accurately by the positioning means when the aperture (or apertures) and the positioning means extend at least substantially in one plane, than when the aperture(s) and positioning means extend in different planes.

Preferably, the positioning means and the at least one aperture are formed in a plate-shaped portion of the cylindrical electrode. In this manner, a high degree of accuracy can be obtained in a simple manner.

The invention also relates to a tubular electrode which can suitably be used in a component according to the invention.

The invention further relates to an electron gun component comprising at least two electrodes having one central and two outer apertures and positioning means.

According to the invention, the electron gun component of this type is characterized in that the positioning means are located at least substantially at the vertices or the sides of a polygon which comprises the centroid of all apertures, and in that they are formed as projections.

Such an electron gun component can be manufactured advantageously by means of the above-described method. The accuracy with which the positions of the apertures are determined is greater when the positioning means are formed by projections. In this case, there is a large distance between the positioning means.

In an exemplary embodiment, in which the electron gun component is an in-line electron gun component, the positioning means comprise reference faces which extend transversely and at least substantially parallel to the in-line plane. In an alternative exemplary embodiment, the positioning means form reference faces which extend at an angle in the range from 30 to 60 degrees relative to the in-line plane.

A further embodiment of the electron gun component according to the invention, in which the at least two electrodes have projections to connect them to a connection member, is characterized in that the projections and the positioning means of each of the at least two electrodes extend at least substantially in one plane. If the projections and the positioning means do not extend in one plane, forces are exerted on the electrode in two different planes during interconnecting the projections and the connection members. This may lead to a deformation of the electrode.

A still further embodiment of the electron gun component according to the invention, is characterized in that at least one electrode has at least one lug which extends between a positioning means and a projection. Said lug can be provided with electric connections in a simple manner.

For each of the exemplary embodiments, the electron gun component may be, for example, a composite electrode, an assembly of electrodes or an entire electron gun.

The invention also relates to a cathode-ray tube comprising an electron gun according to the invention.

BRIEF DESCRIPTION OF THE DRAWING

The invention will be explained in greater detail by means of a few exemplary embodiments and with reference to the accompanying drawing figures, in which.

The Figures are diagrammatic representations and are not drawn to scale, corresponding parts in the different embodiments generally bearing the same reference numerals.

DESCRIPTION OF THE PREFERRED EMBODIMENT(S)

Figure 1:
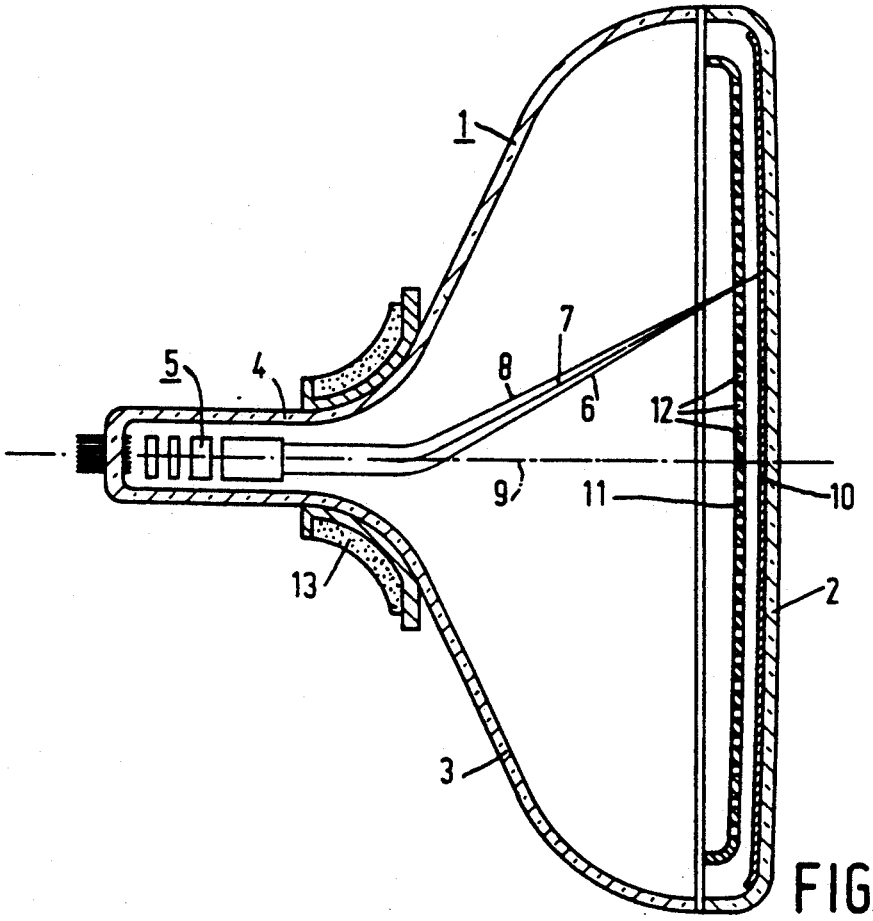
FIG. 1 is a sectional view of a cathode-ray tube which comprises an electron gun manufactured according to the inventive method.

FIG. 1 is a sectional view of a cathode-ray tube comprising an electron gun manufactured according to the invention. In a glass envelope 1 which comprises a display window 2, a cone 3 and a neck 4, an in-line electron gun 5 is arranged in said neck 4, which electron gun generates three electron beams 6, 7 and 8 whose axes are located in the plane of the drawing. In the undeflected state, the axis of the central electron beam 7 coincides with the tube axis 9. The display window 2 is provided on the inside with a large number of triads of phosphor elements. Said elements may consist of, for example, lines or dots. In the present case, the cathode-ray tube comprises linear elements. Each triad comprises a line containing a phosphor luminescing in green, a line containing a phosphor luminescing in blue and a line containing a phosphor luminescing in red. The phosphor lines extend perpendicularly to the plane of the drawing. In front of the display screen a shadow mask 11 is positioned in which a large number of elongated apertures 12 are formed through which the electron beams 6, 7 and 8 pass. The three electron beams which are located in one plane, the in-line plane, are deflected by a deflection-coil system 13.

Figure 2:
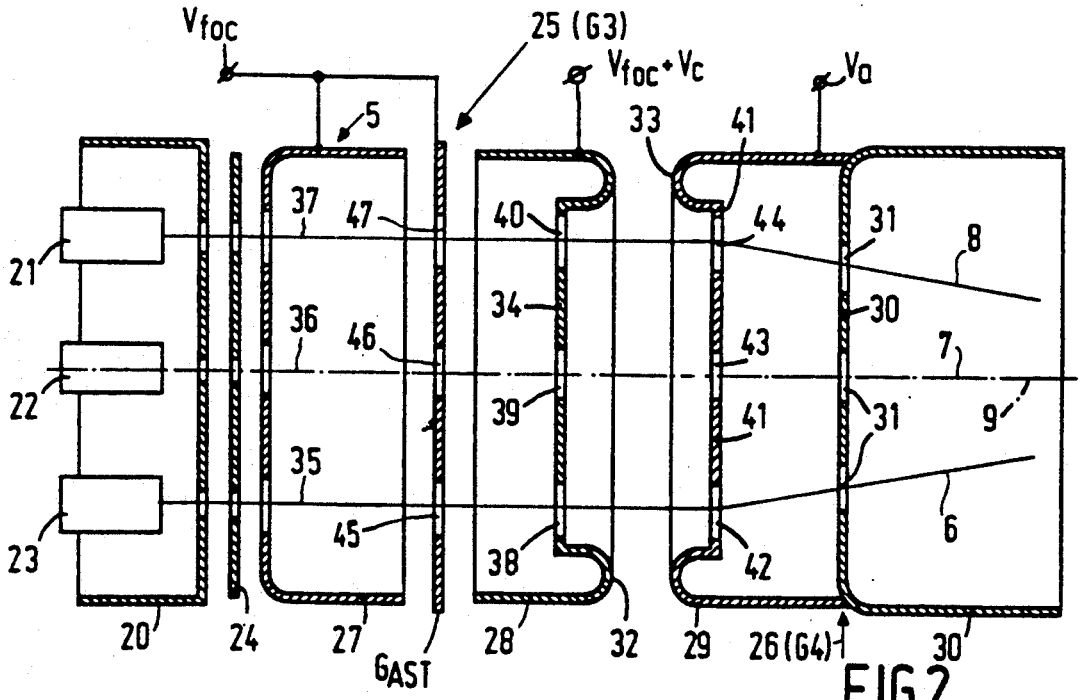
FIG.2 PRIOR ART
FIG. 2 is a sectional view of an in-line electron gun.

FIG. 2 is a partly sectional view of an in-line electron gun. The in-line electron gun comprises a cup-shaped electrode 20 in which three cathodes 21, 22 and 23 are located, and a common plate-shaped screen grid 24. The three electron beams are focused by means of common electrode systems 25 (G3) and 26(G4). Electrode system 25 comprises two cup-shaped parts the open end portions of which face each other, a first electrode 27 and a second electrode 28. The main lens is formed between the first electrode system 25 and the second electrode system 26 and may be of a conventional type or of, for example, the polygon type.

Electrode 26 comprises a cup-shaped part 29 and a centring sleeve 30 the bottom of which contains apertures 31 through which the electron beams pass. Electrode 25 comprises an outer edge 32 which extends towards the electrode 26, and electrode 26 comprises an outer edge 33 which extends towards the electrode 25. Apertures 38, 39 and 40 are formed in the recessed part 34 which extends transversely to the axes 35, 36 and 37 of the electron beams 6, 7 and 8. Apertures 42, 43 and 44 are formed in the recessed part 41 which extends mainly transversely to the axis 36 of the central electron beam. The recessed parts 34 and 41 are integral with the parts 28 and 29, respectively.

In the first electrode system, an astigmatic element is formed by means of an auxiliary electrode $G_{AST}$ which is provided separately at some distance from the main lens as a flat plate having elongated apertures 45, 46 and 47. Said apertures may be, for example, rectangular, oval or diamond-shaped.

The auxiliary electrode is coupled to electrode 27 and comprises means for supplying a constant voltage $V_{foc}$. G3 also comprises means for supplying a control voltage $V_{foc}+Vc$ to electrode 28. It is very important that the electrodes are accurately positioned relative to each other and that the edges of the apertures are undamaged, otherwise this may influence the electric fields between the electrodes.

Not all apertures in the electrodes are in line, some apertures are square or oval. For example, the outer apertures 31 are not in line with the apertures 44 and 42, the apertures 45, 46 and 47 are not round but elongated, as described above. So far, in the assembly of the electron gun the various electrodes were threaded on pins. It will be obvious that an electron gun as shown in FIG. 2 requires pins having a very complex shape.

Figure 3:
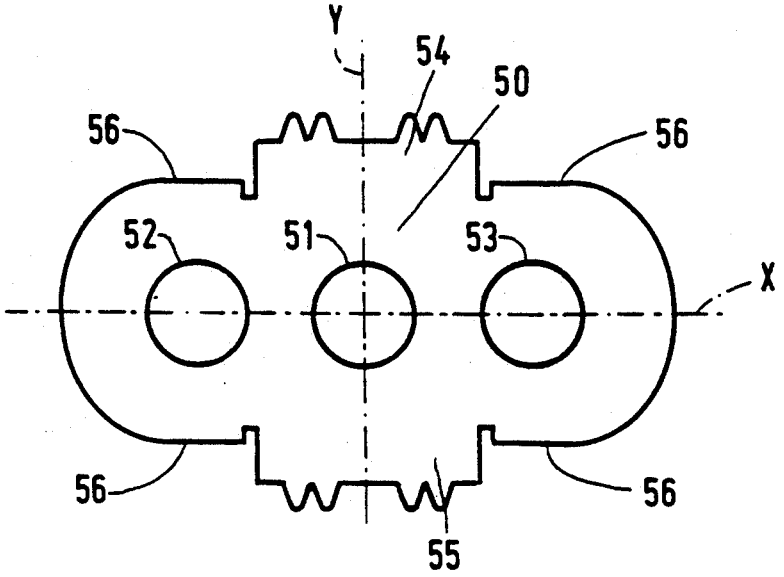
FIG. 3 PRIOR ART
FIG. 3 is a top view of an electrode of an in-line electron gun according to the present state of the art.

FIG. 3 is a top view of an electrode 50 known from JP-A 56-54739. The electrode comprises three apertures 51, 52 and 53. The electrode 50 further comprises two projections 54 and 55, and positioning faces 56.

Figure 4A:
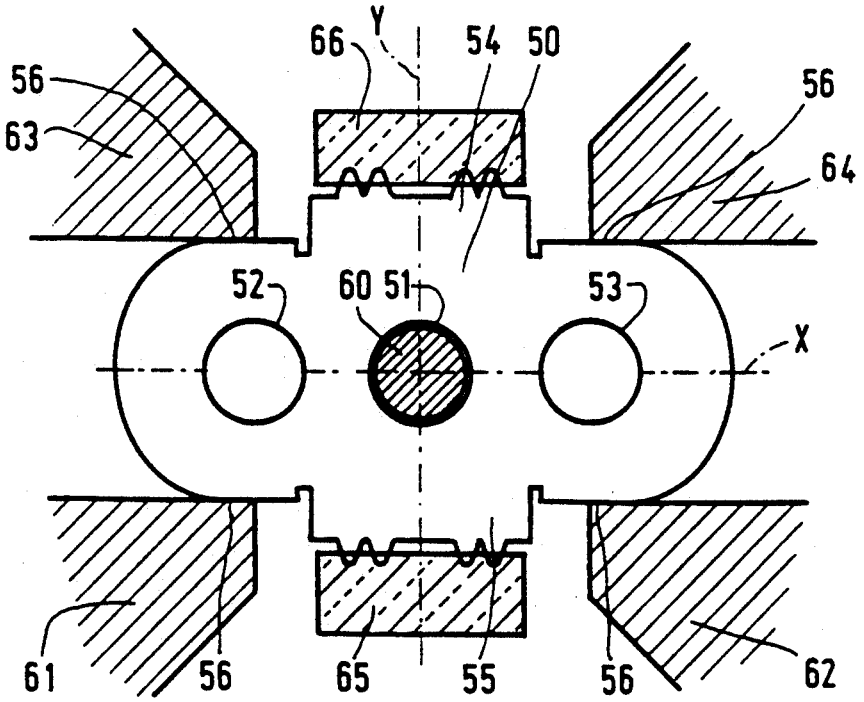
FIG. 4A PRIOR ART
FIGS. 4*a* and 4*b* are top views of an electrode showing how an electrode is positioned in the known method.

FIG. 4*a* is a top view of the manner in which the electrode 50 is positioned according to the state of the art. The electrodes 50 are stacked on a pin 60. The positioning faces 56 cooperate with four jaws 61, 62, 63 and 64. Two of these jaws (62 and 63) are fixed and two (61 and 64) are movable. This enables the electrode to be clamped. Subsequently, the electrodes are interconnected which is normally carried out by pressing a few rods 65 and 66 of ceramic glass, which have been heated to the flow temperature, against the projections 54 and 55. After the rods have cooled, the electrodes are interconnected by the glass rod.

Figure 4B:
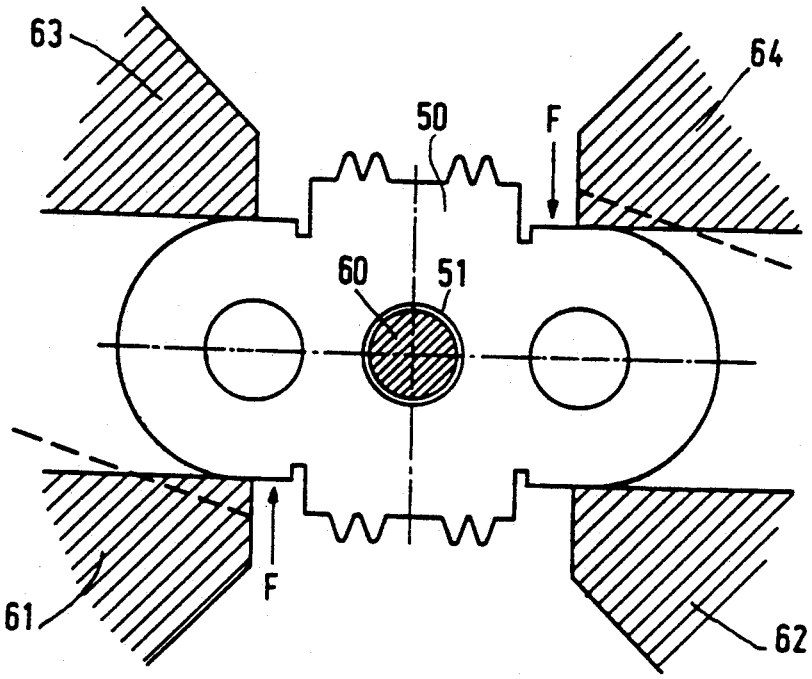
FIG.4B PRIOR ART

FIG. 4*b* again shows, in detail, the manner in which the electrode 50 is positioned. The jaws 61 and 64 are movable and exert a force F on the electrode, thereby urging the electrode against the jaws 63 and 62. However, it has been found that there is a chance that the central pin causes damage to the edges of the central aperture 51 or that the electrode is clamped on the central pin. It is an object of the invention to provide a method in which this problem is obviated. To this end, the method according to the invention is characterized in that no central pin is used to position the electrode, but that it is positioned only by means of positioning means on or at the electrodes and positioning means on, in or at the jig.

Figure 5:
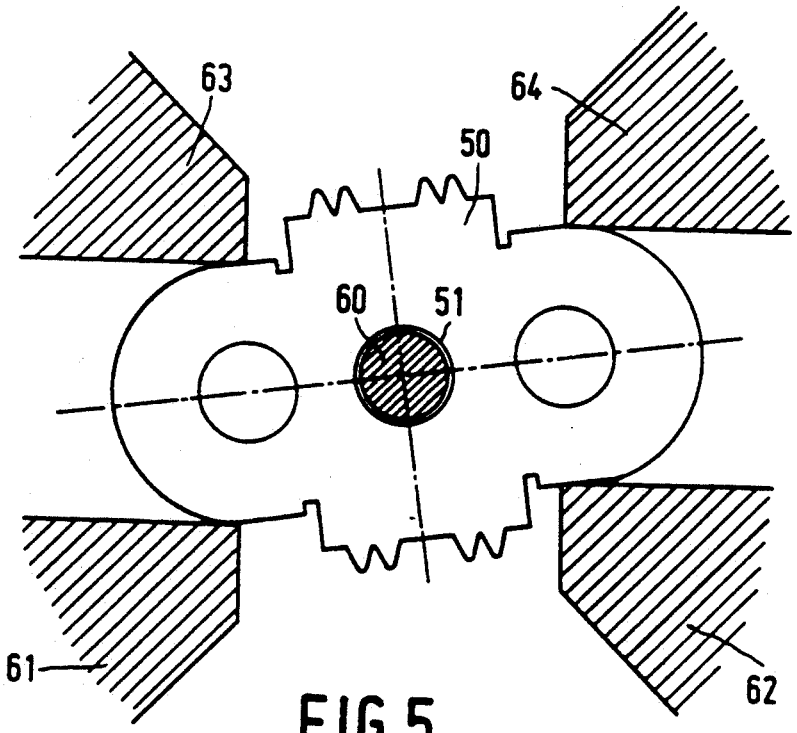
FIG.5 PRIOR ART
FIG. 5 is a top view of an electrode showing a problem which occurs in the known method.

In the known method, problems arise, in particular, when the electrodes are interconnected in such a manner that heat is supplied to the electrodes, for example, when the electrodes are interconnected by means of a heated glass rod or a solder joint. FIG. 5 illustrates why problems occur. Since the central pin 60 and the jaws 63 and 63 are fixedly arranged, the electrode, which has expanded as a consequence of the rise in temperature, will rotate. It will be obvious that this is a problem because the position of the apertures changes. A further consequence of the rotation of the electrode is that the pin may damage the edges of the aperture. It may be possible to fixedly arrange jaws 63 and 64 and movably arrange jaws 61 and 62, so that tilting of the electrode is prevented. When the electrode is heated, however, another problem arises: the electrode 50 expands, but the distance between the jaws 63 and 64 and the central pin 60 does not change. Consequently, the electrode is deformed or the pin is pushed aside. The latter is more likely when the pin is thin. Also in this case the position of the apertures changes and the central aperture may be damaged by the pin. Regarding the accuracy with which the electrodes are positioned, it is to be noted that it has been found in practice that in the case of thin pins, i.e., for electrodes having very small apertures with a cross-section of 1 mm or smaller, the pins do not determine the position of the electrode, but are bent in such a manner that they follow the apertures in the electrode. In the case of such electrodes, the accuracy with which the electrode is positioned is determined by the accuracy with which the apertures are formed in the electrode.

In an embodiment of the method according to the invention, in which the electrodes are interconnected by means of a connection member which can be softened by heat, the positioning means and the further positioning means cooperate only during the provision of the connection member.

In the method according to one embodiment of the invention, the electrodes, when in the "cold" state, are stacked in the jig with clearance. During the provision of the connection member which can be softened by heat, said member being for example a glass rod or a solder joint, the temperature of the electrodes rises. The clearance is selected such that it disappears when the electrodes are heated up.

Consequently, the positioning means and the further positioning means do not lie against each other in the "cold" state. In the "hot" state, the electrodes and the positioning means at least substantially lie against the positioning means of the jig.

Figure 6A:
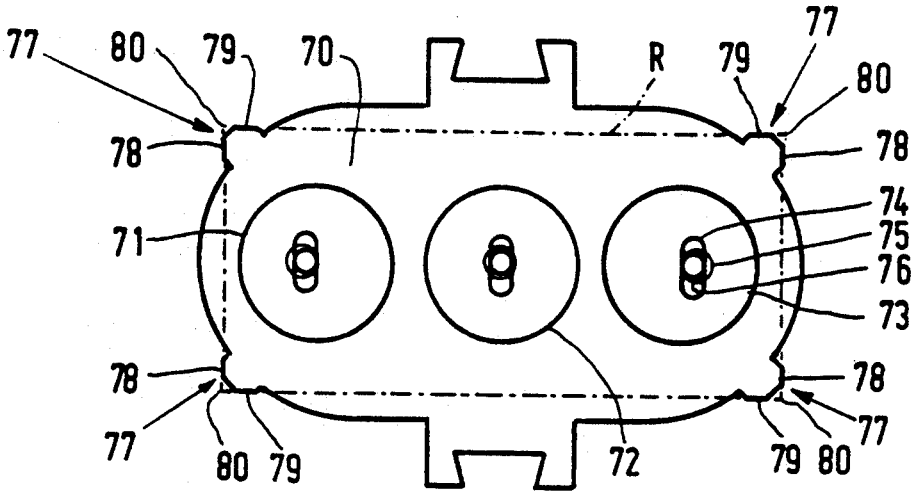
FIGS. 6*a* to 6*d* are top views of electrodes 70 of an electron gun according to the invention.
Figure 6B:
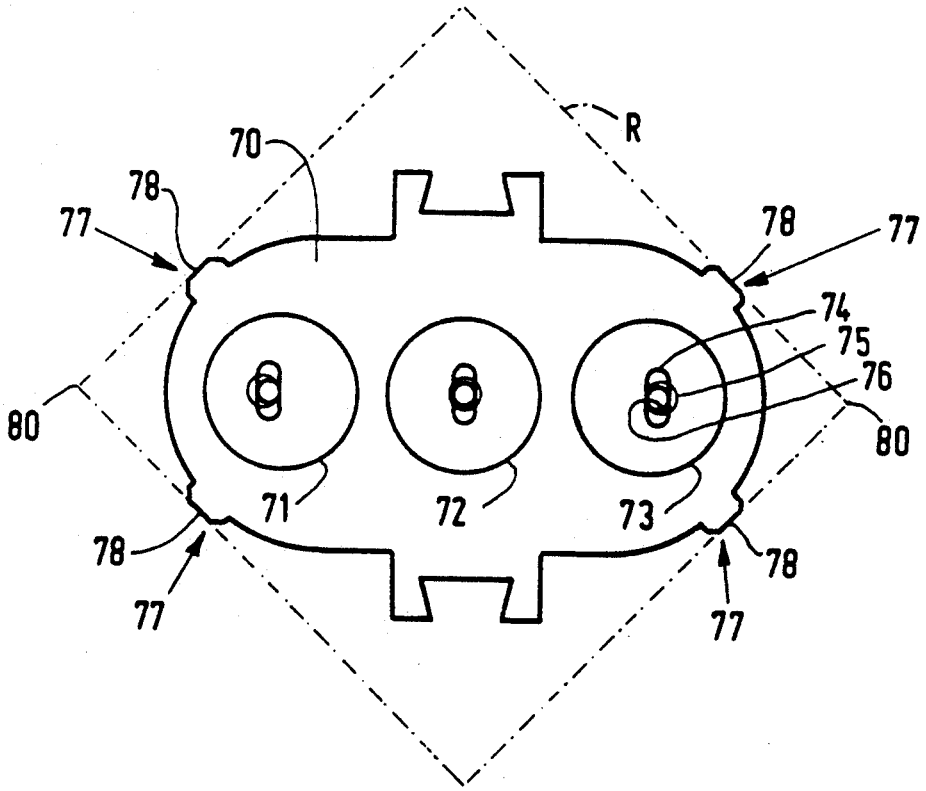

FIGS. 6*a* and 6*b* are top views of an electrode 70 which can suitably be used in an in-line electron gun component manufactured according to the inventive method. The electrode 70 comprises apertures 71, 72 and 73. Apertures of other electrodes are represented by reference numerals 74, 75 and 76. The Figures clearly show that the apertures 73 up to and including 76 are not all in line. The electrode 70 has projections 77 at its outer edge, through which the positioning faces 78 (FIG. 6*b*) or 78 and 79 (FIG. 6*a*) are formed. The positioning faces define a quadrangle R having vertices 80. The centroid of the apertures 71, 72 and 73 lies within the quadrangle.

Figure 6D:
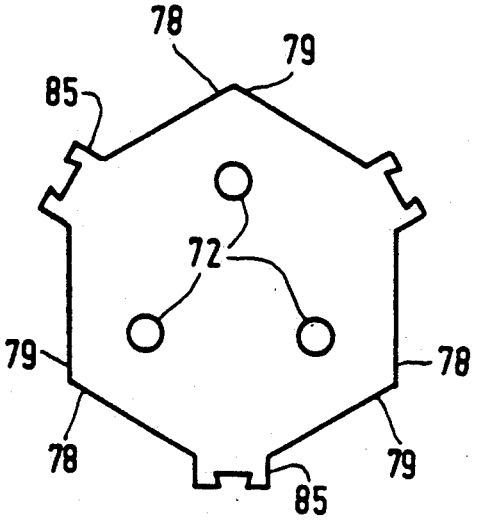
Figure 6C:
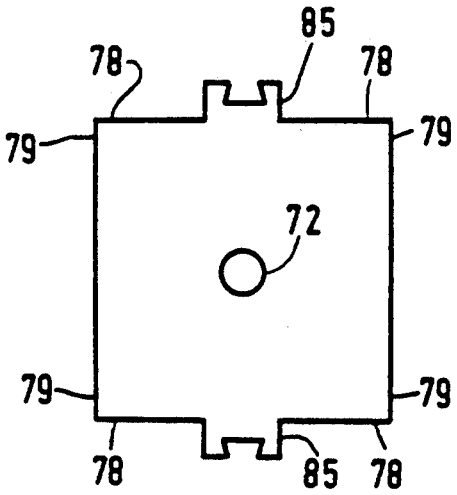

FIGS. 6*c* and 6*d* show further examples of electrodes which can suitably be used in an electron gun manufactured according to the inventive method. FIG. 6*c* shows an electrode having one aperture 72, positioning means formed by reference faces 78 and 79, and securing members 85. FIG. 6*d* shows an electrode which can suitably be used for a delta electron gun manufactured according to the invention. This electrode contains three apertures 72 which are arranged in a triangle, positioning means formed by reference faces 78 and 79 and securing members 85. Reference faces 78 and 79 define a polygon, in the present example a hexagon, within which the centroid of the apertures 72 are located. As the positioning means define a polygon which comprises the centroid of all apertures, the position of the electrode can be determined by the positioning means with a high degree of accuracy. The accuracy with which apertures are positioned is determined by the accuracy with which the apertures in the electrode are formed and by the accuracy with which the electrode is positioned. On the assumption that all parts of the electrodes and the jig are manufactured with approximately equal accuracy, in the present examples, the last-mentioned accuracy is equal to or greater than the accuracy with which the apertures in the electrode are formed.

Figure 7:
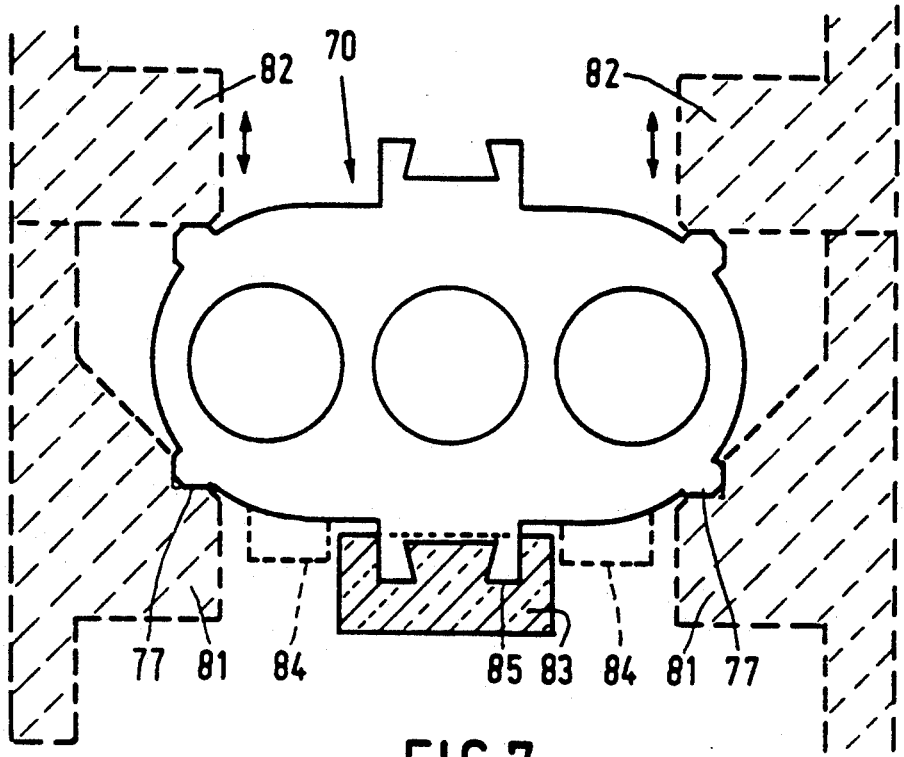
FIG. 7 is a sectional view of an electrode 70 and parts 81 and 82 of a jig.

FIG. 7 is a sectional view of electrode 70 and parts 81 and 82 of a jig. In this Figure, the electrode is connected to a glass rod 83 and provided with lugs 84. Said lugs can be used to form electric connections with the electrode. In the assembly operation, the glass rod is heated to the flow temperature and pressed against projections 85. The parts 81 and 82 are far removed from the glass rod 85, because they are located at the vertices of a polygon which comprises the aperture. Consequently, there is more space for the glass tube, which is advantageous. This results in the parts 81 and 82 being heated less than the jaws shown in FIGS. 4*a* and 4*b*. In this manner, thermal stresses in the parts are reduced. The assembly process can be simplified because the melting-on of the glass rods and the formation of electric connections (via lugs 84) can be carried out simultaneously or almost simultaneously. Also other parts, for example a centring sleeve, can be secured to the electron gun while the electron gun is still in the jig.

Figure 8:
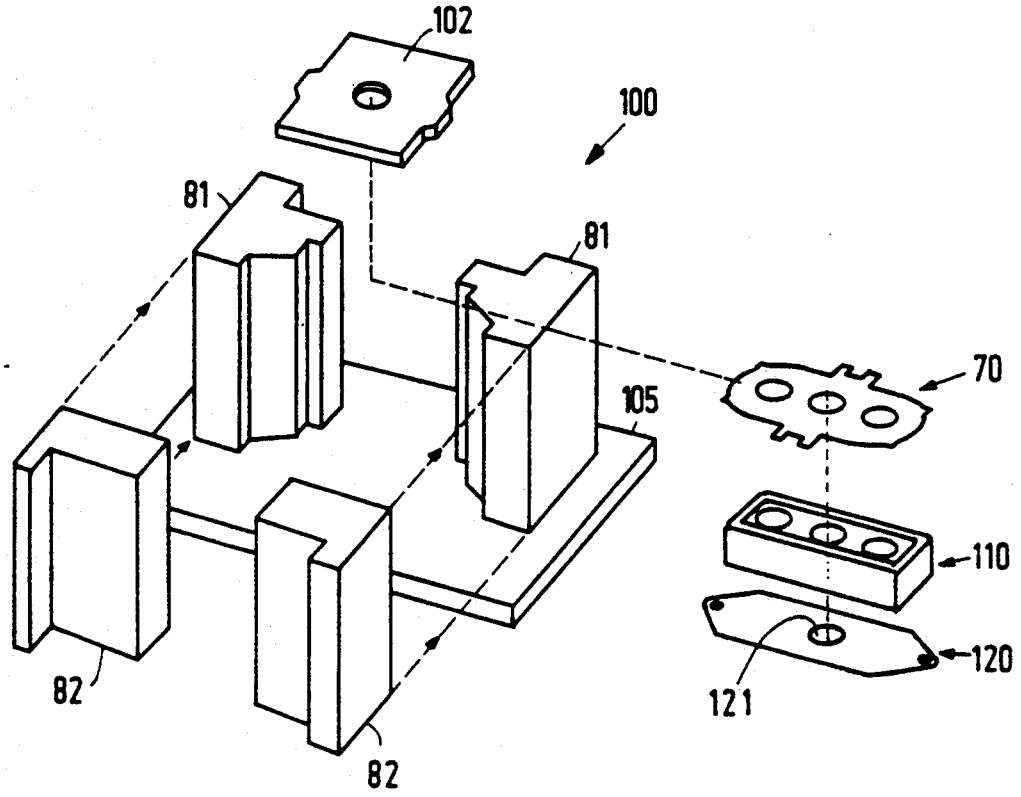
FIG. 8 is a partly perspective elevational view of a jig 100.

FIG. 8 is a partly perspective elevational view of a jig 100. The jig comprises a base plate 105 on which the fixed parts are secured. The jig further comprises the movable parts 82 and an end plate 102. Beside the jig, two electrodes 70 and 110 are shown. They are stacked in the jig together with other electrodes, the distance between the electrodes being defined by spacers 120. The latter are removed after the electrodes are interconnected. While the electron gun or an electron gun component is still in the jig the relative positions of the apertures in the electrodes can be checked, for example, using a laser beam by means of which the contours of the apertures can be scanned. When the accuracy with which the electron gun is manufactured does not meet specific requirements, the electron gun can be removed from the production line immediately after it has been manufactured, thereby saving costs.

Preferably, the positioning means and the jig are produced such that the electrodes fit in the jig with a small clearance in the order of, for example, 10 to 100 μm. Subsequently, a heated glass rod is pressed on the projections. As a consequence hereof, the electrodes expand and, in the heated state, the positioning means cooperate with the further positioning means. Dependent upon the shape and the material of the electrodes, the expansion of the various electrodes does not have to be equal, consequently the clearance of the various electrodes may vary in the cold state.

Figure 9:
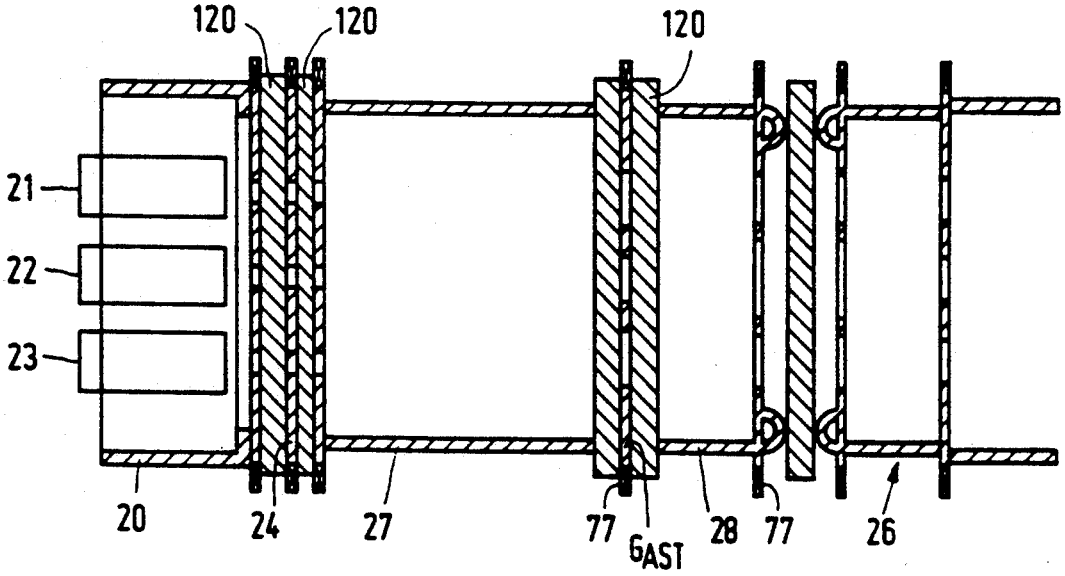
FIG. 9 is a sectional view of an electron gun manufactured according to the inventive method.

FIG. 9 is a sectional view of an electron gun according to the invention during its manufacture. The electrodes are separated by spacers 120. For each electrode the positioning means 77 are located in one plane with the apertures in the electrode. As the positioning means and the apertures are located in one plane, the position of said apertures is determined more accurately than in the case that the positioning means are located in a different plane.

Figure 10A:
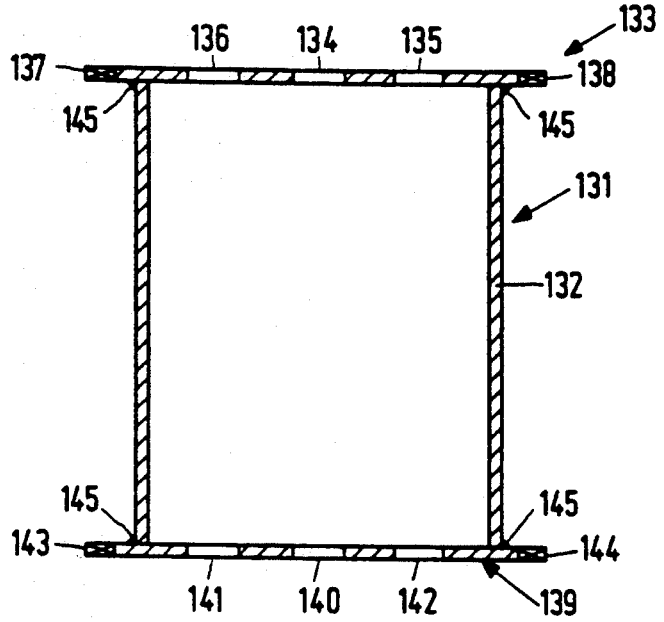
FIGS. 10*a* and 10*b* are sectional views of two electrodes of an electron gun according to the invention.
Figure 10B:
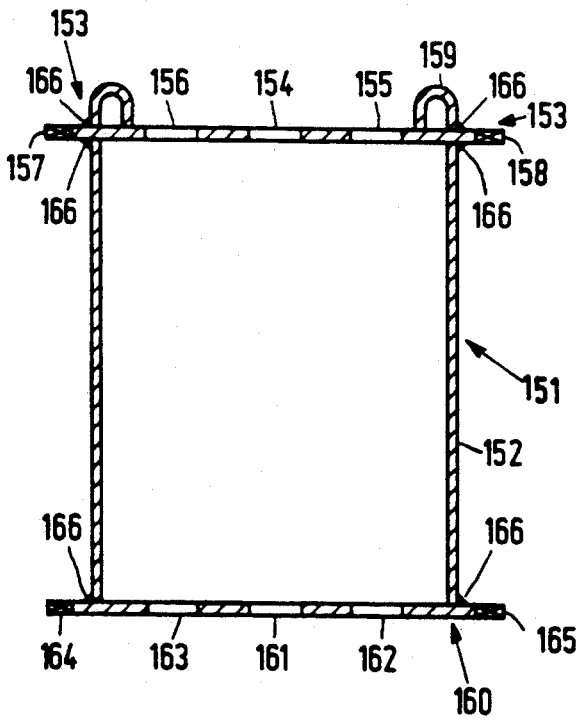
Figure 10C:
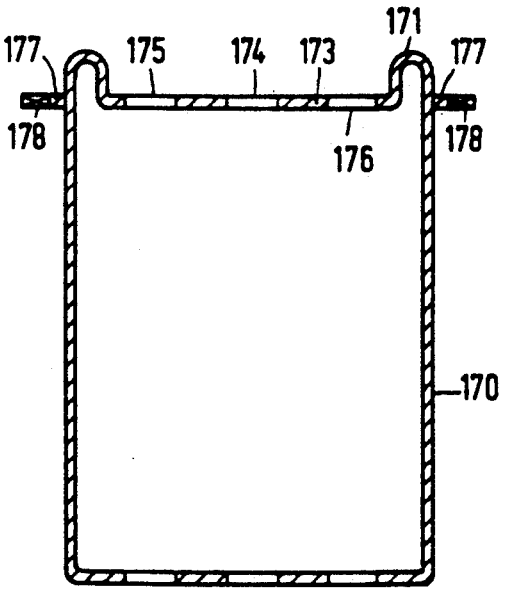
FIG. 10*c* is a further example of an electrode of an electron gun according to the invention.

FIGS. 10*a*, 10*b* and 10*c* are sectional views of electrodes which can suitably be used for an electron gun (or an electron gun component) manufactured according to the inventive method. A tubular electrode 131 comprises a cylindrical portion 132, a plate-shaped portion 133 with apertures 134, 135 and 136, and positioning means 137 and 138, and a plate-shaped portion 139 having apertures 140, 141 and 142 and positioning means 143 and 144. The cylindrical portion and the plate-shaped portions 133 and 139 are secured to each other by means of welding. A tubular electrode 151 comprises a cylindrical portion 152, a plate-shaped portion 153 having apertures 154, 155 and 156 and positioning means 157 and 158, a collar-shaped portion 159 and a second plate-shaped portion 160 having apertures 161, 162 and 163 and positioning means 164 and 165. The plate-shaped portion 153 is secured to the cylindrical portion 152 and the collar-shaped portion 159 by means of welds 166. The cylindrical portion 152 is secured to the plate-shaped portion 160 by means of welds 166. As the apertures and the positioning means are located in one and the same plate-shaped portion, the apertures and the positioning means can be made to extend in one plane in a simple manner. This embodiment is preferred to an embodiment in which the apertures and positioning means are positioned on different portions of the electrode, for example, a cylindrical portion 170 and a collar-shaped portion 171 and a portion 173 having apertures 174, 175 and 176 can form an entity which is provided on the outside with projections 177 on which the positioning means 178 are provided, as is shown in FIG. 10*c*. With such an electrode it is more difficult to accurately position the apertures and the positioning means relative to each other than with an electrode as shown in FIG. 10*b*. The cylindrical portions 132, 152, 170 may be of various shape or form, e.g. the cross-section may be circular triangular, quadrangular, or polygonal. It may have sharp or rounded corners. It may be provided with internal or external projections. It may change in diameter.

Figure 11:
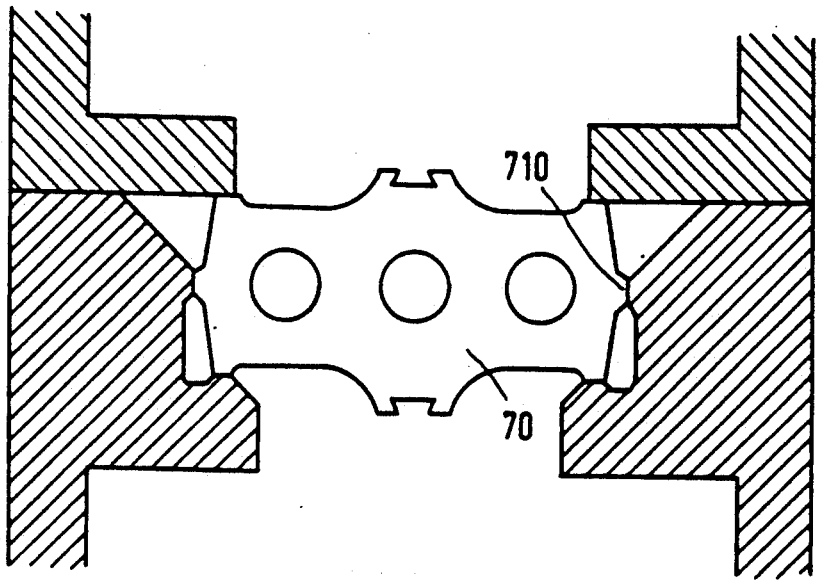
FIG. 11 is a top view of a further jig which can suitably be used in the method according to the invention.

FIG. 11 is a top view of a further embodiment of a jig which can suitably be used in the method according to the invention. The portions 81 of the jig differ from the portions 81 of the jig shown in FIG. 7. The electrode 70 comprises positioning means 710 in the in-line plane. It has been found that when the positioning means are located in the in-line plane an improved positioning of the electrode in the in-line plane is obtained.

It will be obvious that within the scope of the invention many variations are possible to those skilled in the art.

We claim:

1. An electron gun component comprising a plurality of electrodes, each having a plurality of apertures through which respective electron beam axes pass, each of at least two of the electrodes including a positioning means to facilitate assembling and interconnecting the plurality of electrodes during manufacture of the electron gun component, characterized in that each of the positioning means comprises a plurality of projections extending away from the centroid of an area defined by centers of the plurality of apertures, said plurality of projections defining vertices of a polygon having a centroid which substantially coincides with the centroid of said area.

2. An electron gun component comprising a plurality of electrodes, each having a plurality of apertures through which respective electron beam axes pass, each of at least two of the electrodes including a positioning means to facilitate assembling and interconnecting the electrodes during manufacture of the electron gun component, characterized in that each of the positioning means comprises a plurality of projections extending away from the centroid of an area defined by centers of the plurality of apertures, said plurality of projections defining sides of a polygon having a centroid which substantially coincides with the centroid of said area.

3. An electron gun component as in claim 1 or 2 where said axes define the vertices of a triangle.

4. An electron gun component as in claim 1 or 2 where at least one of said projections includes a reference face extending transversely of a plane defined by said axes and where at least one of said projections includes a reference face extending substantially parallel to said plane.

5. An electron gun component as in claim 1 or 2 where the at least two electrodes include securing projections; for securing said electrodes to a securing member, characterized in that the securing projections and the positioning means projections of each of said electrodes lie substantially in a common plane.

6. An electron gun component as in claim 5 where each of the at least two electrodes includes a lug which extends between one of the securing projections and one of the positioning means projections of said electrode.

7. An electron gun component comprising a plurality of electrodes, each having a central aperture through which an electron beam axis passes, each of at least two of the electrodes including a positioning means to facilitate assembling and interconnecting the plurality of electrodes during manufacture of the electron gun component, characterized in that each of the positioning means comprises a plurality of projections extending away from said axis and defining vertices of a polygon having a centroid which falls within the central aperture of the respective electrode.

8. An electron gun component comprising a plurality of electrodes, each having a central aperture through which an electron beam axis passes, each of at least two of the electrodes including a positioning means to facilitate assembling and interconnecting the plurality of electrodes during manufacture of the electron gun component, characterized in that each of the positioning means comprises a plurality of projections extending away from said axis and defining sides of a polygon having a centroid which falls within the central aperture of the respective electrode.

9. An electron gun component as in claim 7 or 8 where the centroid of at least one of the polygons substantially coincides with the center of the central aperture of the respective electrode.

10. An electron gun component as in claim 7 or 8 where each of the electrodes has a plurality of in line apertures through which respective electron beam axes pass.

11. An electron gun component as in claim 10 where at least one of said projections includes a reference face extending transversely of a plane defined by said axes and where at least one of said projections includes a reference face extending substantially parallel to said plane.

12. An electron gun component as in claim 11 where at least one of said projections includes both a first reference face extending transversely of a plane defined by said axes and a second reference face extending substantially parallel to said plane.

13. An electron gun component as in claim 10 where at least one of said projections includes a reference face extending at an angle in the range of about 30 to 60 degrees relative to a plane defined by said axes.

14. An electron gun component as in claim 13 where each of said projections includes a reference face extending at an angle in the range of about 30 to 60 degrees relative to a plane defined by said axes.

15. An electron gun component as in claim 7 or 8 where each of the at least two electrodes has a single aperture.

16. An electron gun component as in claim 7 or 8 where the at least two electrodes include securing connection projections for securing said electrodes to a securing member, characterized in that the securing projections and the positioning means projections of each of said electrodes lie substantially in a common plane.

17. An electron gun component as in claim 16 where each of the at least two electrodes includes a lug which extends between one of the securing projections and one of the positioning means projections of said electrode.

* * * * *